United States Patent [19]

Chap

[11] Patent Number: 4,848,620

[45] Date of Patent: Jul. 18, 1989

[54] NESTABLE STACKABLE BIN BASKET

[75] Inventor: John P. Chap, Lemont, Ill.

[73] Assignee: Selfix, Inc., Chicago, Ill.

[21] Appl. No.: 303,094

[22] Filed: Jan. 27, 1989

Related U.S. Application Data

[63] Continuation of Ser. No. 139,987, Dec. 31, 1987, abandoned.

[51] Int. Cl.[4] ..... A45F 3/00

[52] U.S. Cl. ..... 220/19; 206/505; 206/513

[58] Field of Search ..... 220/19; 206/505, 511, 206/512, 513, 515, 518, 507

[56] References Cited

U.S. PATENT DOCUMENTS

| | | | |
|---|---|---|---|
| 2,950,825 | 8/1960 | Averill | 206/505 X |
| 3,752,352 | 8/1973 | Senecal | 220/19 |
| 4,298,127 | 11/1981 | Upshaw et al. | 220/19 X |
| 4,361,234 | 11/1982 | Hawes et al. | 220/19 X |
| 4,456,125 | 6/1984 | Chap | 220/19 X |

*Primary Examiner*—Steven M. Pollard

*Attorney, Agent, or Firm*—Dressler, Goldsmith, Shore, Sutker & Milnamow, Ltd.

[57] ABSTRACT

An improved, plastic-coated wire bin arrangement is disclosed which greatly facilitates convenient and versatile use of the bin. The bin comprises a plurality of interconnected first and second members which generally define the bottom, sides, front and back of the bin. The bin further includes receiving recesses, and protruding support members which readily permit stacking of more than one bin. A gap between the front wall and side walls allows the front wall to be more flexible. The flexible front wall, recesses and support members, are configured to permit substantial nesting of a plurality of bins in an easy, convenient and compact manner. Accordingly, separation of nested bins is also convenient and simple.

15 Claims, 2 Drawing Sheets

NESTABLE STACKABLE BIN BASKET

This application is a continuation of application Ser. No. 139,987, filed Dec. 31, 1987.

TECHNICAL FIELD

The present invention relates generally to plastic coated wire household items such as shelves and baskets, and more particularly to a plastic coated wire bin arrangement which is configured for convenient stacking and nesting with like bin units.

BACKGROUND OF THE INVENTION

Plastic coated wire products are widely available in the form of shelves, racks, baskets, and other like household conveniences. These extremely popular consumer items are usually fabricated from metal wire which is appropriately shaped, and which is metal plated or coated with vinyl or other plastic materials. The resultant wire product is suitably corrosive and scratch resistant. Vinyl coating is available in a variety of colors for pleasing appearance.

Coated or plated wire products such as baskets or bins have proven popular and useful. Such products include interconnected wire members which typically define an open topped basket or bin having a bottom and, typically, a plurality of side walls, usually four. Such baskets, bins and other products are often intended to nest one inside another for storage, shipping, and display. In use, however, it is often desirable to stack such products one on top of another.

Nestability and stackability are normally inconsistent objectives. To nest, the bottom of a product, such as an open topped bin or basket, is made smaller than the top, and the sides are flared so one product can fit within another like product. To stack, the bottom of one product sits on the top of another, i.e., the dimensions of the bottom of one product is at least as large as the top of another. Thus, designing a product to stack involves requirements which conflict with the structural configurations for nesting. To accommodate these conflicting objectives, some products are provided with interengageable members to facilitate stacking. Often, these interengageable members extend outwardly from the sides of the products, making nesting difficult and, even where possible, results in limiting the nestability of such products.

A number of products, such as baskets or bins, are usually nested in an effort to reduce space requirements for shipping, storage, and display. Since many stores are self-service stores, it is highly desirable for customers to be able to quickly and easily separate a product such as a bin or basket from a nest so that a unit being purchased can be readily removed.

To this end, a coated wire bin unit combining the convenience of a stackable bin arrangement with the desirable features of easy and compact nesting would be particularly useful and desirable.

SUMMARY OF THE INVENTION

In accordance with the present invention, there is disclosed a stackable and nestable basket or bin unit adapted to be nestable in, as well as supported by, and stacked upon a like unit. A bin/basket incorporating the present invention is configured so a plurality of like products can be nested one in another. One embodiment of such a bin/basket unit is fabricated from metal wire which is coated or plated for corrosion resistance. Typically, the unit is fabricated from plastic coated wire to provide an inexpensive, pleasing, resilient finish.

A bin/basket unit in accordance with the present invention comprises a plurality of laterally spaced apart first members which generally define a bottom and which include portions which extend up to define spaced apart front and back walls. The bin/basket unit further includes a plurality of laterally spaced apart second members oriented generally transverse to and connected to the bottom, defining portions of the first members. The second members include portions at opposite ends extending generally upward from the bottom of the unit to generally define a pair of spaced apart side walls.

The back wall extends between the side walls and is firmly secured thereto. The front wall flares outwardly from the bottom of the bin unit and is not connected to the adjacent side walls to thereby define a gap between the front wall and the side walls. This configuration enhances the relative flexibility of the front wall and facilitates substantial and easy nesting of a plurality of like bins.

A bin/basket unit incorporating the present invention, achieves a high degree of nestability, as well as stackability. Such a unit includes a plurality of stacking or support members extending laterally out from the bottom thereof. These stacking support members are adapted to interact with and rest on the top of another such unit so the two units stack one on the other.

One embodiment of a bin unit incorporating the present invention includes a pair of side support members extending out beyond the side edges of the bottom of the bin unit a distance sufficient to be positionable on the upper edge of another such bin unit. As can be appreciated, in such an arrangement, the outwardly extending stacking support members, designed to facilitate stacking of one unit on another, can interfere with the capability of one such unit to nest within another, and inevitably seem to limit the capability of forming a stack of nested units.

This is overcome by the a bin/basket unit incorporating the present invention which includes a bottom and a plurality of walls, including side walls, a back wall and a front wall, with the side walls and back wall being interconnected to form a single, unitary structure. The front wall is not connected to the adjacent side walls, but is spaced therefrom to define a gap therebetween. When the bin units incorporating the present invention are nested, the lateral stacking support members are received in the gap between the front wall and the forward edges of the side walls. The narrowest, lowermost reaches of the gaps are sufficiently large to receive the stacking support members without interference. In this manner, the bin units may be nested as fully as possible without interference from the stacking support members and without the necessity of having to tip or tilt a unit to insert or remove it from a nest.

Numerous other advantages and features of the present invention will become readily apparent from the following detailed description of the invention and embodiment thereof, from the claims, and from the accompanying drawings in which like numerals are employed to designate like parts throughout the same.

DETAILED DESCRIPTION

Figure 1:
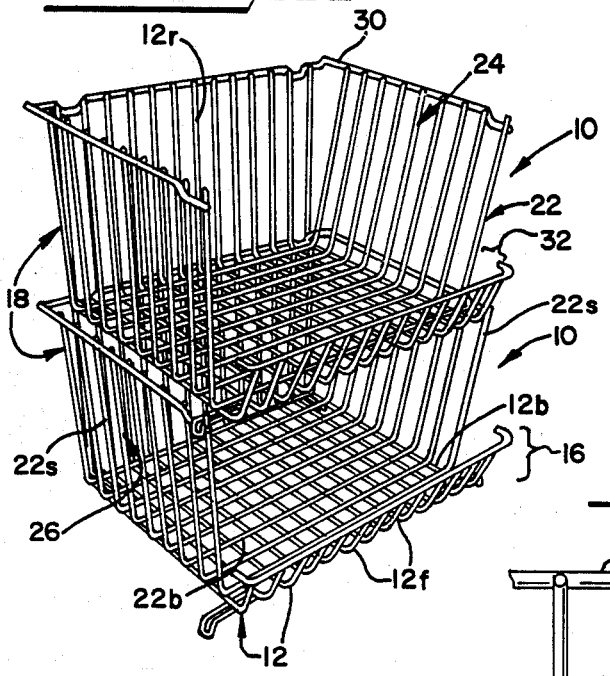
FIG. 1 is a perspective view illustrating a pair of stacked bin/baskets, incorporating the present invention.
Figure 2:
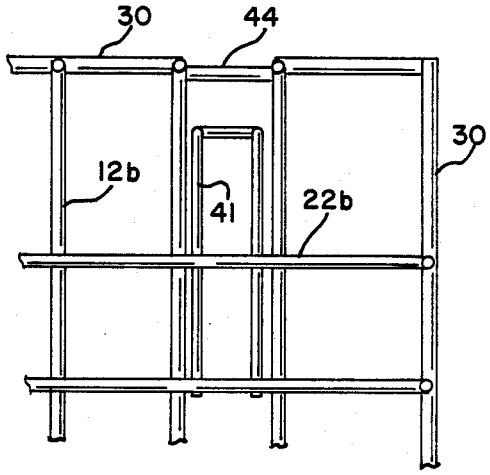
FIG. 2 is a fragmentary top plan view generally taken along line 2—2 of FIG. 5.
Figure 3:
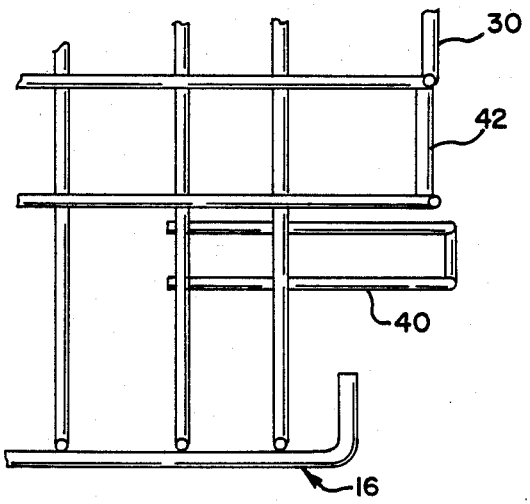
FIG. 3 is a fragmentary top plan view taken along line 3—3 of FIG. 5.
Figure 4:
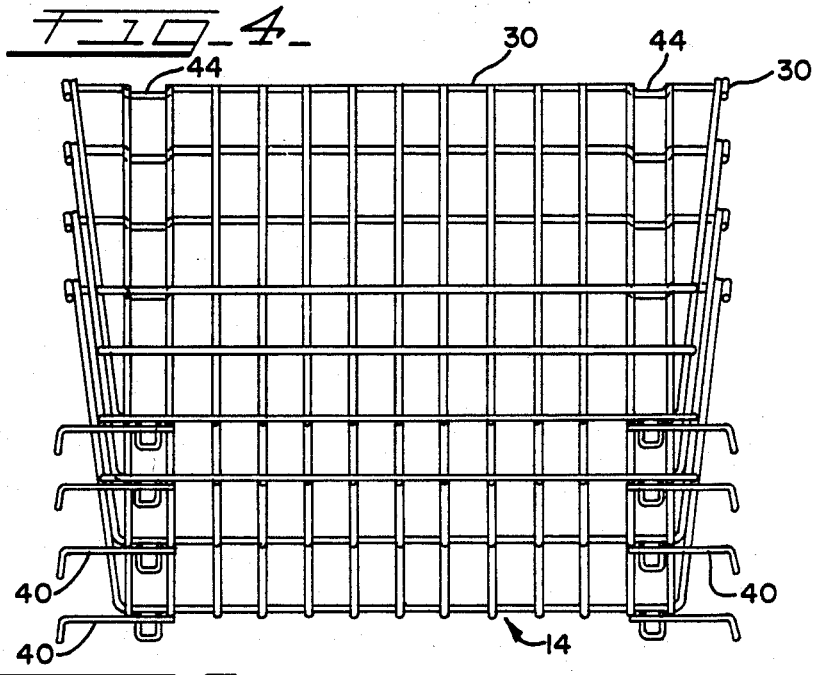
FIG. 4 is a front elevational view illustrating a nest of bin/baskets incorporating the present invention.

While the present invention is susceptible to embodiment in various forms, there is shown in the drawings and will hereinafter be presently preferred embodiments with the understanding that the present disclosure is to be considered as exemplification of the principles of the invention and is not intended to limit the invention to the embodiments illustrated.

With reference now to the drawings, a pair of bins or baskets 10 incorporating the present invention are illustrated in FIG. 1. Each bin 10 is preferably constructed from plastic-coated metal wire members which are appropriately shaped. The plastic coating may comprise vinyl or like material which is suitably durable and corrosion-resistant, and which is typically available in a wide variety of colors for enhancing the aesthetic appeal of the bin. Alternatively, the bin 10 may be decoratively plated. The bin 10 may be fabricated in accordance with known methods, typically comprising suitable interconnection of the various members of the baskets, such as by welding, with the entire arrangement thereafter plastic-coated or plated.

As illustrated, bin 10 includes a plurality of generally parallel, laterally spaced apart first members 12. Each first member contains a bottom portion **12*b*. The bottom portions 12*b* together generally define the bottom 14 of the bin 10. The spaced apart first members 12 each further include a generally upwardly and outwardly extending front portion 12*f* which generallydefine the front 16 of the bin 10. Similarly, the members 12 each include a generally upwardly and outwardly extending rear portion 12*r* which together generally define the rear or back 18 of the bin 10**.

The bin 10 further includes a plurality of spaced apart, generally parallel second members 22 extending generally transverse to the first members 12. Each second member 22 includes a bottom portion **22*b* connected with the bottom portion 12*b* of the first members 12 and together therewith defining the bottom 14 of the bin 10. Each of the second members 22 includes opposite side portions 22*s* extending generally upward from the bottom of the bin 14 and generally defines a pair of laterally spaced left and right side walls 24, 26, respectively. As shown in the drawing, front wall 16, back wall 18, and the side walls 24, 26 flare upward and outward to facilitate nesting. The back wall 18 extends between the side walls 24, 26 and is firmly secured thereto by upper edge element 30**.

The front wall 16 extends upwardly from the bottom 14 of the bin and is spaced from the forward edges of the side walls 24, 26 to define a gap 32 therebetween. The absence of connection between front wall 16 and side walls 24, 26 acts to enhance the relative flexibility of the front wall 16 and acts to facilitate substantial and ready nesting of a plurality of the bins 10, one within the other.

Nesting is an important feature of the bins 10, because they are nested for storage, shipment, and display. When the bins nest tight together, less space is required for a given number of units. If the bins nest easily, less time is required to form the nest and remove one unit for sale. As is shown in the drawing, substantial nesting is achieved by slipping the protruding support members 40, 41 of one bin/basket 10 into the gap 32 of the one below.

Not only is substantial and ready nesting achieved, but it is simple and easy to denest. Denesting is important because bins are often displayed in a nested form in a self-service store. A customer is able to remove the number of bins to be purchased and leave the remaining bins in an orderly fashion.

Figure 5:
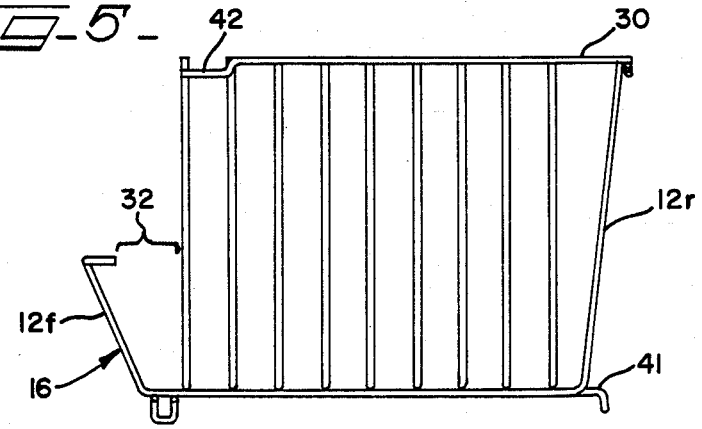
FIG. 5 is a side elevational view illustrating a bin/basket.
Figure 6:
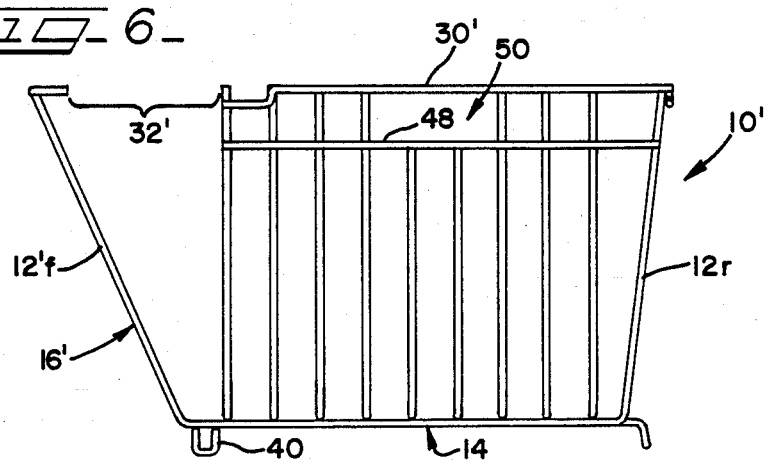
FIG. 6 is a side elevational view illustrating an alternative embodiment thereof.

The height of the front wall 16 can vary depending on the use for the bin 10. FIG. 5 shows a partial front wall 16, which is useful because access to all bins 10 is still available when stacked in a vertical arrangement, as shown in FIG. 1. FIG. 6 shows a full front wall 16'. This embodiment allows for greater utility of the space there within the basket, thereby holding more, but may limit access to the lower baskets when stacked in a vertical arrangement, as shown in FIG. 1.

In addition to the gap 32, easy nesting is facilitated by the angle between the bottom 14 and the front wall 16 being greater than the angle between the bottom 16 and the side walls 24, 26. In the illustrated embodiment, the angle between the bottom, back, and side walls is between 95 100 degrees measured from the bottom of the basket 14. The angle between the bottom of the basket 14 and the front wall 16 is between 110 and 115 degrees. This larger angle allows more clearance and flexibility, thereby enhancing the ready and substantial nesting of one bin 10 in another.

An upper edge member or element 38 extends along the upper edge of the back and side walls. The upper edge element 30 is utilized when bins are stacked. Stacking is facilitated by a plurality of recesses 42, 44 formed in the upper edge member 30, which are adapted to receive protruding support members 40, 41, respectively, of a unit stacked thereon.

The support members 40, 41 protrude out from the bottom 14 and are receivable in the receiving recesses 42, 44 of a like bin 10 positioned thereunder. Depending upon placement of the receiving recesses 42, 44 in the upper edge member 30, the protruding support members 40, 41 will be positioned accordingly. In the illustrated embodiment, the pair of protruding support members 40 are located at the forward portion of the bottom 14, extending laterally out from the side edges thereof and are receivable in the gap 32 when the bin 10 is nested inside another like bin.

The stacking relationship between the protruding support members 40, 41 and the receiving recesses 42, 44 is best illustrated in FIG. 1. A plurality of bins 10 may be stacked in a vertical arrangement. The bin's own weight and frictional engagement of the protruding support members 40, 41 and the receiving recesses 42, 44 allow the basket to remain in place. If additional locking is required, the angle on the side and back walls 24, 26 and 18 respectively can be increased slightly. When the protruding support members 40, 41 are installed in the receiving recesses 42, 44, the protruding support members 40, 41 tend to draw the side and back walls together slightly, providing a tension force tending to increase the stability of the bins.

As best seen in FIG. 6 an additional lower parallel reinforcing handle member 48 can be placed parallel to the upper edge member 30', slightly spaced below the upper edge member. The upper edge member 30' and lower parallel reinforcing handle member 48 are attached to a plurality of the first and second members, with those first and second members intersecting the handle member 48 terminating at that intersection, thereby creating an opening or handle 50 between the upper edge element 30' and the parallel handle member 48. The parallel handle member 48 not only defines the handle 50, but also acts to reinforce the entire bin 10'.

Thus, a plastic-coated wire bin is disclosed which includes features which will permit stacking and nesting of the bin with one or more like bins. These features greatly facilitate convenient, compact, and versatile use of the bin.

From the foregoing, it will be observed that numerous variations and modifications may be affected without departing from the true spirit and scope of the novel concepts of the present invention. It will be understood that no limitation with respect to the specific apparatus illustrated herein is intended or should be inferred. It is, of course, intended to cover by the appended claims all such modifications as fall within the scope of the claims.

What is claimed is:

1. A bin adapted to hold articles, comprising:

a plurality of spaced-apart, first elongate members;

a plurality of spaced-apart, second elongate members extending generally transverse to said first members;

said first members and said second members having central portions lying generally in a plane to define a bottom;

said first members having opposite side end portions extending generally upwardly and outwardly from the plane of said bottom definingcentral portions at opposite ends thereof to define a pair of tapered side walls;

said second members having opposite front and back end portions extending generally upwardly and outwardly from the plane of said bottom defining central portions at opposite front and back ends thereof to define tapered front and back walls, respectively, disposed between and firmly secured to said side walls;

said front ends of said central portions of said second members being located at a point spaced forwardly of the forwardmost one of said first members to define uninterrupted coplanar extensions of said central portions of said second members forming a support receiving gap between said forwardmost first member and said front ends of said central portions of said second members;

the lower end of said front wall being spaced away from and forwardly of said side walls to further define said support receiving gap therebetween;

stacking means formed as a part of the upper edges of said side walls; and a plurality of support members extending out from the periphery of said bottom, the free end portions of said support members interacting with said stacking means in a like bin disposed therebelow for supporting one said bin on another in a stack, a pair of said support members being receivable without obstruction in said support receiving gap for nesting a pair of said like bins one within the other.

2. A bin as claimed in claim 1, wherein:

said front wall is shorter than said side walls.

3. A bin as claimed in claim 1, wherein:

said front wall is generally the same height as the side walls.

4. A bin as claimed in claim 1, wherein:

said back and side walls are flared outwardly relative to said bottom at generally a first angle; and said front wall flares out relative to said bottom at a second angle greater than said first angle.

5. A bin as claimed in claim 4, wherein:

said first angle is between 95 and 100 degrees measured from bottom of basket; and said second angle is between 110 and 115 degrees measured from bottom of basket.

6. A bin as claimed in claim 1, including:

an upper edge member extending along the upper edge portions and interconnecting said back and side walls.

7. A bin as claimed in claim 6, wherein:

said stacking means comprises a plurality of receiving recesses formed in said upper edge member; and said plurality of support members being receivable in said recesses of a like bin positioned thereunder for supporting one said bin in said like bin in a stack.

8. A bin as claimed in claim 7, wherein:

said pair of said support members receivable in said gap when said bin is nested inside another like bin extend out from the sides of said bottom forwardly of the forwardmost one of said first members.

9. A bin adapted to hold articles, comprising:

a plurality of spaced apart, first elongate members and a plurality of spaced apart, elongate second members disposed transverse to and connected with said first members to define a bottom;

said first members having portions extending up from the front and back ends of said bottom to define a front wall and a back wall, respectively;

said second members being generally U-shaped and having portions extending generally upward from the side edges of said bottom to define a pair of spaced apart side walls located on either side of and connected to said back wall;

the most forward one of said second members being spaced backwardly from the front end of said bottom to define a support receiving gap therebetween;

a continuous upper edge element extending along and connected to the upper edge of said side walls and said back wall;

stacking means comprising a plurality of recesses formed integrally as a part of said upper edge element;

a plurality of support members extending out from said bottom and receivable in said recesses in a like bin disposed therebelow for supporting one said bin on another in a stack; and said front wall extending up from the forward edge of said bottom at a point spaced forwardly of the forward edge of said side walls for receiving selected ones of said support members in said gap without obstruction to facilitate nesting of one bin in another.

10. A bin as claimed in claim 9, wherein:

said selected ones of said support members comprise a pair of support members extending out from opposite sides of said bottom adjacent the forward edge thereof forwardly of said side walls and rearwardly of said front wall in alignment with said support receiving gap between; and said pair of selected support members being received in recesses formed at the forward end of said upper edge element for stacking one said bin on another like bin therebelow, and receivable in said gap between the forward end of said side walls and said front wall for nesting one said bin in another like bin.

11. A bin as claimed in claim 10, including:

a pair of said support members extending out from the back of said bottom and receivable in recesses of a like bin positioned thereunder for supporting said bin on another like bin in a stack, and receivable between adjacent back end portions of said second members when said bin is nested inside another like bin.

12. A bin as claimed in claim 9, including:

an additional lower reinforcing handle member disposed generally parallel to said upper edge member;

said reinforcing handle member being connected to said first and second members to define at least one handle between said upper edge member and reinforcing handle member.

13. A bin as claimed in claim 9, wherein:

said bin is constructed of plastic-coated metal wires.

14. A bin as claimed in claim 8, wherein:

a pair of said support members extend out from the back of said bottom, being receivable in recesses of a like bin positioned thereunder for supporting said bin on another like bin in a stack, and receivable between adjacent back end portions of said second members when said bin is nested inside another like bin.

15. A bin as claimed in claim 1, comprised of plastic-coated metal wire.

* * * * *